US005348088A

United States Patent [19]

Laflin et al.

[11] Patent Number: 5,348,088

[45] Date of Patent: Sep. 20, 1994

[54] COILED TUBING EXTERNAL CONNECTOR WITH PACKING ELEMENT

[75] Inventors: Walter J. Laflin, Houston; Arthur J. Morris, Magnolia, both of Tex.

[73] Assignee: Camco International Inc., Houston, Tex.

[21] Appl. No.: 91,483

[22] Filed: Jul. 13, 1993

[51] Int. Cl.[5] ..... E21B 33/129

[52] U.S. Cl. ..... 166/134; 166/242; 285/323

[58] Field of Search ..... 166/85, 134, 380, 242; 285/323, 348

[56] References Cited

U.S. PATENT DOCUMENTS

| | | | |
|---|---|---|---|
| 3,062,291 | 11/1962 | Brown | 166/134 |
| 3,215,207 | 11/1965 | Sizer | 166/134 |
| 3,282,342 | 11/1966 | Mott | 166/134 |
| 3,394,762 | 7/1968 | Young | 166/134 |
| 3,410,348 | 11/1968 | Page | 166/134 |
| 4,107,452 | 8/1978 | Razui | 285/323 |
| 4,311,196 | 1/1982 | Beall et al. | 166/134 |
| 4,326,588 | 4/1982 | McStravick | 166/134 |
| 4,862,957 | 9/1989 | Scranton | 166/134 |
| 5,251,695 | 10/1993 | Coronado | 166/242 |
| 5,253,705 | 10/1993 | Clary et al. | 166/134 |

*Primary Examiner*—Ramon S. Britts
*Assistant Examiner*—Frank S. Tsay
*Attorney, Agent, or Firm*—Fulbright & Jaworski

[57] ABSTRACT

A well connector connectable to the outside of coil tubing for coupling the tubing to another member. The connector includes a tubular body externally enclosing the end of the coil tubing and a second end for connection to another member. A slip housing is threadably connected to the first end of the body and encloses slips between the body and the housing for gripping the outside of coil tubing. The body includes a thermally compensated packing element and a threaded actuation energizer is provided threadably engaging the body, separate from the slip actuation, for energizing the packer element into a seating engagement with the exterior of the coiled tubing.

9 Claims, 4 Drawing Sheets

COILED TUBING EXTERNAL CONNECTOR WITH PACKING ELEMENT

BACKGROUND OF THE INVENTION

The present invention is directed to a coiled tubing connector for oil and gas wells for sealingly connecting equipment such as completion equipment, jars, downhole motors, hydraulic disconnects and other well tools to the coil tubing.

It is conventional to seal between the connector and the coil tubing utilizing seals such as O-rings. However, the coil tubing is plastically deformed each time it is spooled onto and off of a reel and becomes ovalized. With use and general wear and tear of the coil tubing, conventional seal means in use fail thereby interfering with the operation of various downhole types of connected well tools.

The present invention provides an external connector for a coil tubing having a packing element which can be energized to provide a highly reliable seal and one which is energized independently from the slip mechanism so as not to be affected thereby, and may be thermally compensated to afford a positive pressure seal across a wide range of temperatures, such as −40° F. to +250° F.

SUMMARY

The present invention is directed to an external well connector connectable to the outside of one end of well coil tubing for coupling the coil tubing to another member. The connector includes a tubular body having first and second ends. The first end is sized to externally enclose the one end of the coil tubing and the second end includes connecting means for connection to another member. A slip housing is threadably connected to the first end of the body and slip means are positioned in the slip housing and engagable with the first end of the body in position to engage and grip the outside of the coil tubing on movement of the slip housing and first end of the body together for actuation of the slips. The tubular body includes a packing element positioned to engage the exterior of the coil tubing. Threaded actuated energizing means is threadably engaging the body, separate from the slip actuation, for energizing the packing element into a sealing engagement with the exterior of the coil tubing.

Yet a further object of the present invention is wherein the body includes a wall transverse to the longitudinal axis of the body and positioned adjacent to the packing element, and a plurality of elements extending perpendicularly through the wall and positioned between the threaded actuated energizing means and the packing element. In one embodiment, the elements are circular pins and in another embodiment, the elements are arcuate in cross section.

Still a further object of the present invention is the provision of a connector including a split ring positioned adjacent the packing element and the threaded actuated energizing means extends through the body and engages the split ring for pressing the split ring against the packing element. In one embodiment, the engaging means preferably includes threaded screws extending perpendicularly to the longitudinal axis of the body.

Still a further object of the present invention is wherein the body includes first and second parts which are threadably connected together, with the packing element therebetween, forming an energizer means for setting the packer element. Yet a further object of the present invention is wherein the threads connecting the slip housing and the threads connecting the energizing means to the body are identical.

A still further object is the provision of thermal compensation by energizing and sealing at low temperatures and providing for thermal expansion of the sealing element without loss of the sealing by providing springs or voids.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

Figure 1A:
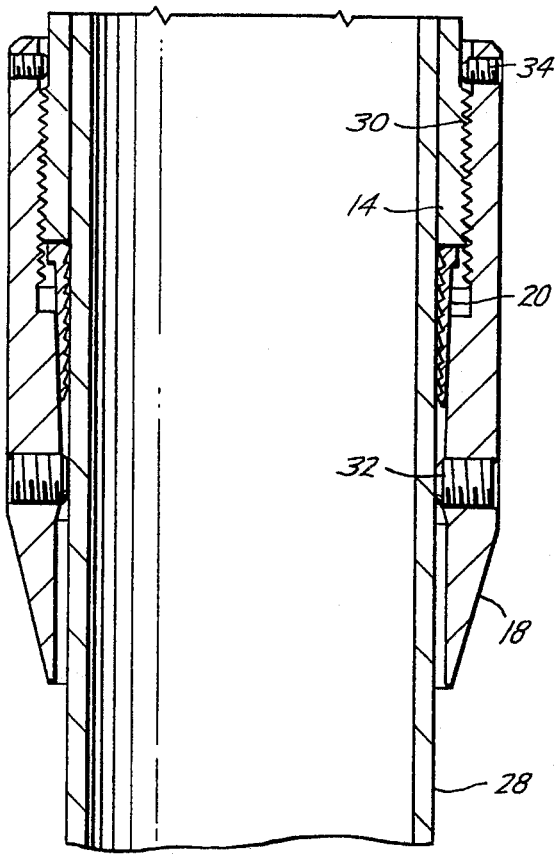
FIGS. 1A and 1B are continuations of each other and form an elevational view, in cross-section, of one form of the present invention.

Referring now to the drawings, and particularly to FIGS. 1A. 1B and 2, the reference numeral 10 generally indicates the external well connector of the present invention which is connectable to the outside of one end of a coiled tubing 28 for coupling the coiled tubing 28 to another member. The connector 10 generally includes a tubular body 12 having a first end 14 and a second end 16, a slip housing 18, slips 20, a packing element 22, and a thread actuated energizing means 24.

The first end 14 of the tubular body 12 is sized to externally enclose one end 26 of the coiled tubing 28. The second end 16 includes any suitable connecting means for connecting to other types of well tools such as jars, completion equipment, downhole motors, hydraulic disconnects, vibratory impact tools, etc. Such connecting means may be by welds, threads, or other types of connections.

The slip housing 18 is threadably connected to the first end 14 of the body 12 by coacting threads 30. The slips 20 are positioned in the slip housing 18 and engagable with the first end 14 of the body 12 and have coacting wedge surfaces between the slip housing 18 and the slips 20. The slips 20 include teeth for engaging the exterior of the coil tubing 28. Upon movement of the slip housing 18 and the first end 14 of the body 12 toward each other, by rotating the slip housing relative to the body 12, the slips 20 are actuated to grip and hold the coil tubing 30. Preferably, a set screw 32 is provided between the slip housing 18 and the coil tubing 30 and a set screw 34 is provided between the slip housing and the body 12 thereby insuring that the slips 20, when set, are held in a gripping relationship with the coil tubing 28.

The packing element 22 is positioned to engage the exterior of the coil tubing 28. Preferably, an anti-extrusion device such as a wire mesh 36 or KEVLAR is positioned on each end of the packer element 22, and a spring such as a Belleville washer 38 is provided adjacent the packing element 22 for compensating packing dimension changes due to thermal expansion. Thrust washers 40 and 41 are provided on opposite sides of the Belleville washer 38.

The tubular body 12 may include a wall 42 transverse to the longitudinal axis of the body 12 and adjacent the packing element 22. The threaded energizing means includes a threaded ring 44 which is threadably connected to the body 12 by coacting threads 46, a split spacer 48, and a plurality of pins 50 which extend through the wall 42 and engage the thrust washer 41. The packing element 22 is energized by tightening the threaded ring 44 on the body 12 which transmits a compressive load across the split spacer 48, the pins 50 and against the thrust washer 41, the Bellville washer 38 and against the packing element 22. The circular pins 50 are circularly spaced around the wall 40 to provide an even compressive force on the packing element 22. The number of pins 50 will vary depending upon variables such as the packing material, geometry, pin material and size. While the packing element 22 may be of any suitable material, one satisfactory material is hydrogenated nitrile (HNBR). After the packing element 22 is energized the threaded ring 44 is locked in place by tightening set screws 52. Preferably the threads 30 between the slip housing and body 12 and the threads 46 between the threaded ring 24 and the body 12 are identical to allow the threaded ring 24 to be easily installed on the body 12. It is to be noted that the packer seal 22 is energized independently from the slips 20. That is, the slips 20 ace set in place and anchored by rotation of the slip housing 18 while the packer element 22 is energized and set by rotation of the threaded ring 24 relative to the body 12. The packing element 22 can thus be firmly and securely set into place and maintain a sealing relationship with the exterior of the coil tubing 28 even though the coil tubing has been cycled on and off of its spool and becomes ovalized.

Figure 1B:
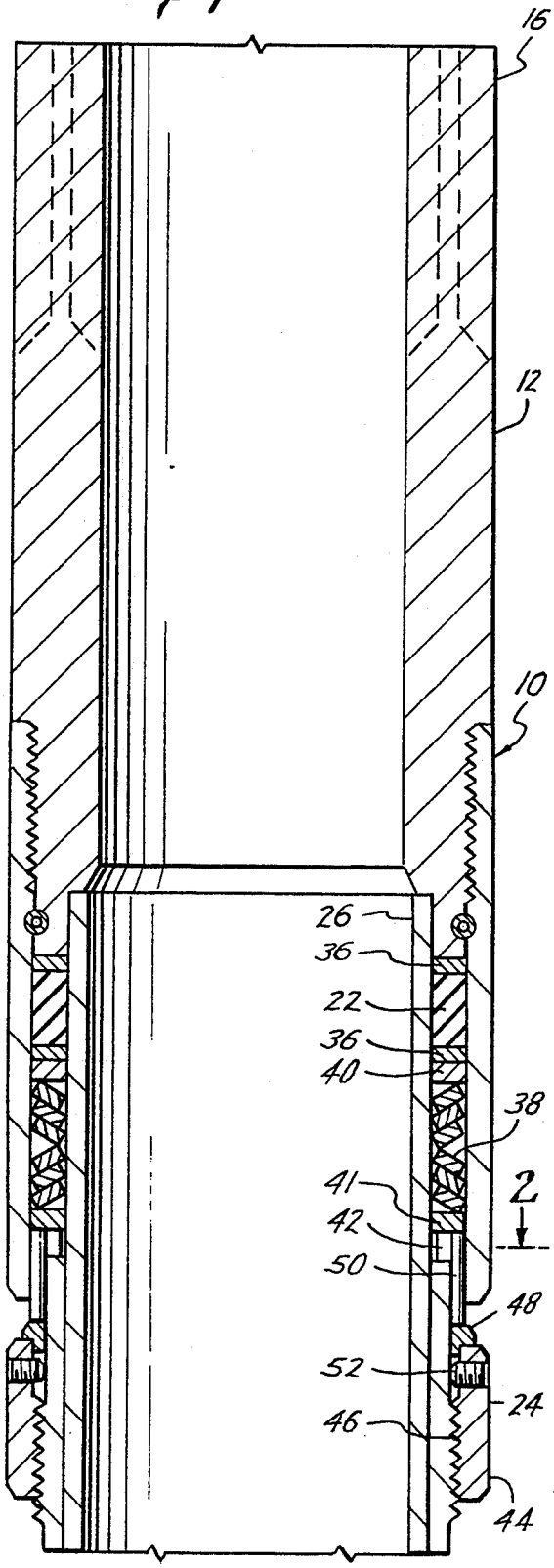
Figure 2:
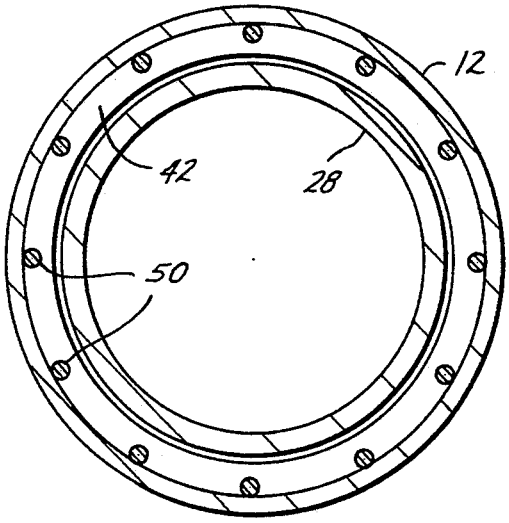
FIG. 2 is a cross-sectional view taken along the line 2—2 of FIG. 1B, FIGS. 3A and 3B are continuations of each other and together form an elevational view, in cross-section, of another form of the present invention.
Figure 3A:
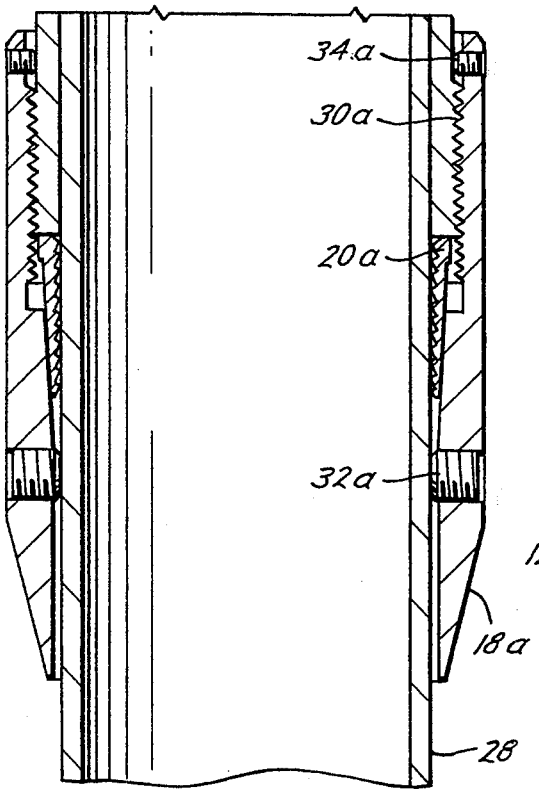
Figure 3B:
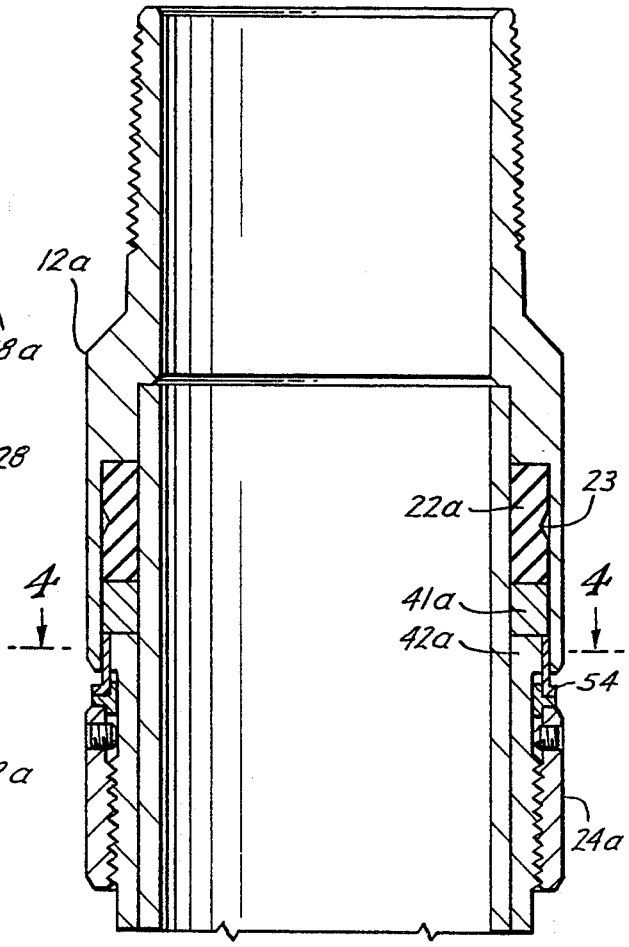
Figure 4:
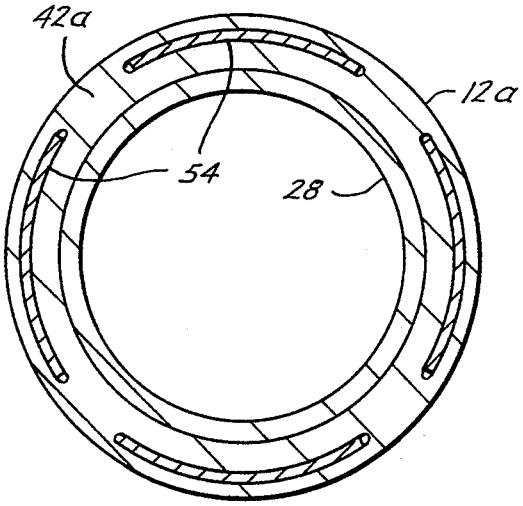
FIG. 4 is a cross-sectional view taken along the line 4—4 of FIG. 3B, FIGS. 5A and 5B are continuations of each other and together form an elevational view, in cross-section, of still another form of the present invention.

Other and further embodiments may be provided, as hereinafter described, where like parts to those shown in FIGS. 1A, 1B and 2 will be similarly numbered with the addition of the suffix "a", "b", and "c".

Referring now to FIGS. 2, 3A and 3B and 4, the anti-extrusion rings and Belleville spring have been omitted for clarity. In this embodiment, instead of the pins 50 a plurality of arcuate, in cross section, compression rings 54 are used which extend longitudinally through the wall 42*a* of the body 12*a* for providing a uniform compression force against the thrust washer 4*a* while energizing the packing element 22*a*. Temperature compensation may be obtained by void 23 in the packing element 22*a*.

Figure 5A:
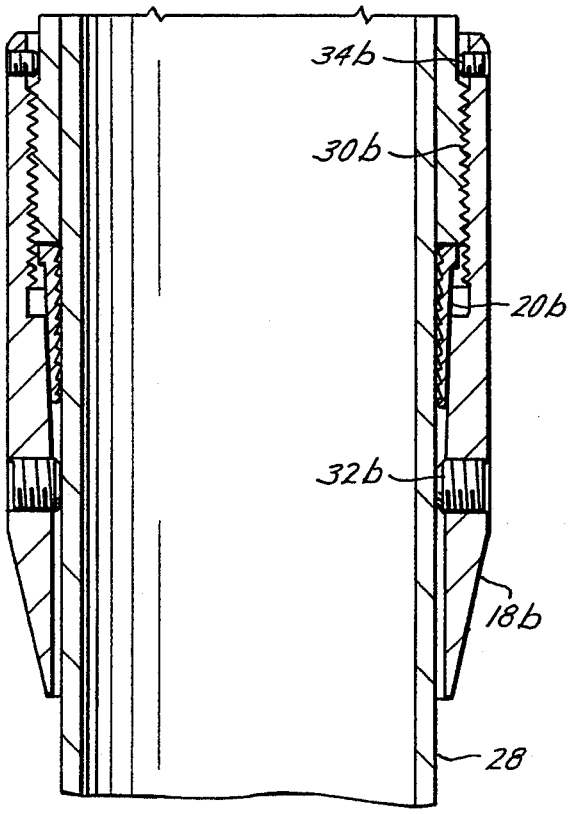
Figure 5B:
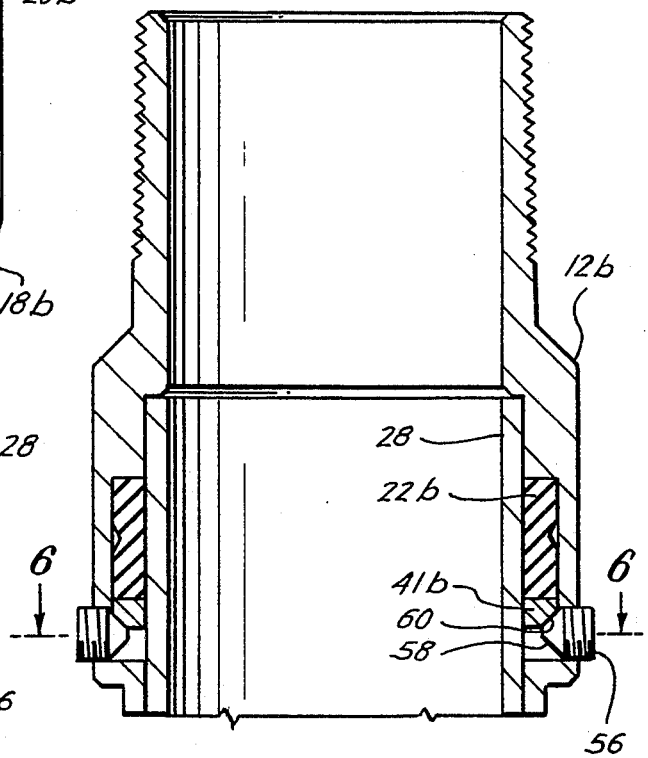
Figure 6:
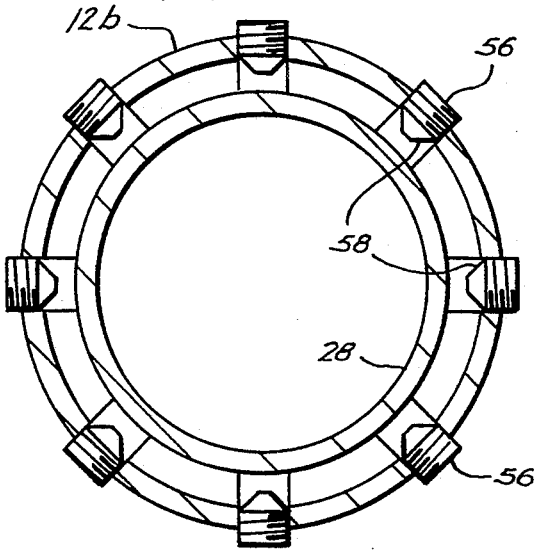
FIG. 6 is a cross-sectional view taken along the line 6—6 of FIG. 5B, FIGS. 7A and 7B are continuations of each other and together form an elevational view, in cross-section, of still a further embodiment of the present invention.

Referring now to FIGS. 5A, 5B and 6 the threaded actuating energizing means includes a plurality of threaded set screws 56 which extend perpendicular to the longitudinal axis of the body 12*b*, the set screws 56 each include a tapered face 58 which engages a taper 60 on the thrust ring 4l*b* for applying a compressive force against the packing element 22*b*. Preferably, the set screws 56 extend around the body 12*b* to provide a uniform compressive force on the packing element 22*b*.

Figure 7A:
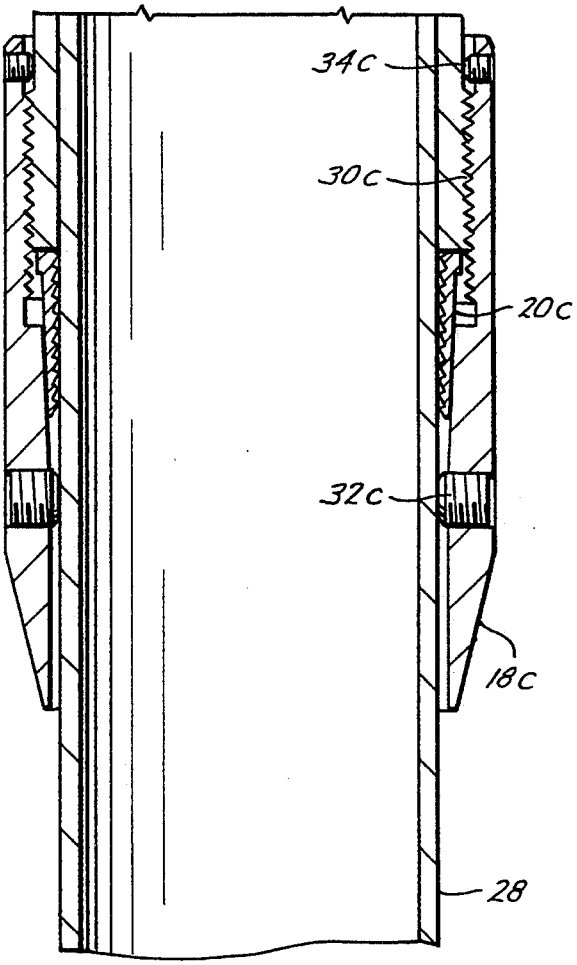
Figure 7B:
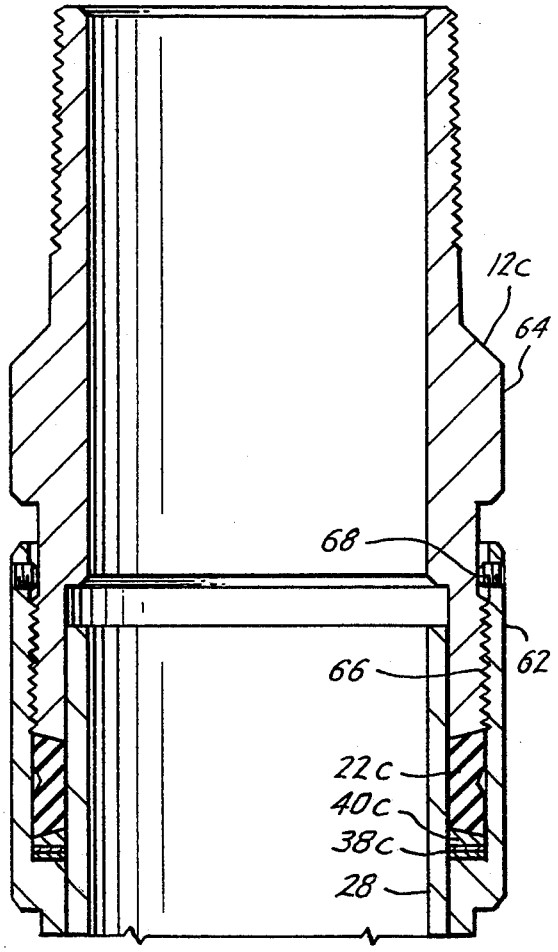

Referring now to FIGS. 7A and 7B, the body 12*c* consists of components 62 and 64 which are threadably connected together by coacting threads 66. The parts 62 and 64 with the packing element 22 therebetween form an energizer means for setting the packing element 22*c*. The relative rotation of the parts 62 and 64 compress the packing element 22*c* and the energy is stored therein by the Belleville washers 38*c* acting against a thrust washer 40*c*. Body parts 62 and 64 are locked together by set screws 68.

The present invention, therefore, is well adapted to carry out the objects and attain the ends and advantages mentioned as well as others inherent therein. While presently preferred embodiments of the invention have been given for the purpose of disclosure, numerous changes in the details of construction, will be readily apparent to those skilled in the art, and which are encompassed within the spirit of the invention and the scope of the appended claims.

What is claimed is:

1. A well connector connectable to the outside of one end of well coiled tubing for coupling the coiled tubing to another member comprising, a tubular body having first and second ends, the first end sized to externally enclose the one end of the coiled tubing, said second end including connecting means for connecting to the other member, a slip housing connected to the first end of the body, slip means positioned in the slip housing and engagable with the first end of the body and positioned to engage and grip the outside of the coiled tubing on movement of the slip housing and the first end of the body together for actuation of the slips, actuating means for moving the slip housing and the first end of the body together for actuation of the slips, said tubular body including a packing element positioned to engage the exterior of the coiled tubing, said packing element spaced out of contact with the slip means, and threaded actuated energizing means threadably engaging the body, separate from the slip actuating means, for energizing the packing element into a sealing engagement with the exterior of the coiled tubing.

2. The connector of claim 1 wherein the body includes a wall transverse to the longitudinal axis of the body and positioned adjacent the packing element and a plurality of elements extending perpendicularly through the wall and positioned between the threaded actuated energizing means and the packing element.

3. The connector of claim 2 wherein the elements are pins.

4. The connector of claim 2 wherein the elements are arcuate in cross section.

5. The connector of claim 1 including, a thrust washer positioned adjacent the packing element, said threaded actuated energizing means extending through the body and engaging the thrust washer for pressing the thrust washer against the packing element.

6. The connector of claim 5 wherein the energizing means includes threaded screws extending perpendicularly to the longitudinal axis of the body.

7. The connector of claim 1 wherein the body includes first and second parts threadably connected together, with the packing element therebetween, forming an energizer means for setting the packer element.

8. The connector of claim 1 wherein the threads connecting the slip housing to the body and the threads connecting the energizing means to the body are identical.

9. The connector of claim 1 including thermal compensating means positioned adjacent the packer element.

* * * * *